US005311972A

United States Patent [19]

Plath

[11] Patent Number: 5,311,972

[45] Date of Patent: May 17, 1994

[54] LUGGAGE WITH ATTACHABLE COMPONENTS

[76] Inventor: Robert V. Plath, 3030 NE 44th St., Lighthouse Point, Fla. 33064

[21] Appl. No.: 859,086

[22] Filed: Mar. 27, 1992

[51] Int. Cl.[5] ..... A45C 13/10; A45C 13/40

[52] U.S. Cl. ..... 190/102; 190/108; 190/110

[58] Field of Search ..... 190/102, 108, 110; 206/277, 287.1; 24/700, 704.1, 701; 150/110, 113

[56] References Cited

U.S. PATENT DOCUMENTS

| | | | |
|---|---|---|---|
| 523,503 | 7/1894 | Alberschardt | 190/108 |
| 922,567 | 5/1909 | Cosgrove | 190/108 |
| 1,084,360 | 1/1914 | Rahm | 190/108 |
| 1,151,310 | 4/1915 | Waldes | 24/700 X |
| 1,361,096 | 12/1920 | Puc | 24/700 X |
| 1,514,578 | 11/1924 | Carr | 24/700 X |
| 2,372,845 | 4/1975 | Nelson | 190/108 |
| 2,606,636 | 8/1952 | Braverman | 206/287.1 |
| 2,989,998 | 6/1961 | Harris | 190/108 |
| 3,564,590 | 2/1971 | Hebel | 206/287 X |
| 3,606,372 | 9/1971 | Browning | 190/108 X |
| 3,696,850 | 10/1972 | Rosenblum | 190/108 |
| 4,170,282 | 10/1979 | Schwartzstein | 190/108 X |
| 4,206,835 | 6/1980 | Shapiro | 190/108 |
| 4,233,715 | 11/1980 | McDermott | 24/704.1 X |
| 4,416,319 | 11/1983 | Hofmann | 24/701 X |
| 4,420,068 | 12/1983 | Gerch | 190/108 X |
| 4,424,891 | 1/1984 | Smith | 190/108 X |
| 4,489,829 | 12/1984 | Myers et al. | 206/287.1 |
| 4,621,404 | 11/1986 | Browning | 190/102 X |
| 4,738,341 | 4/1988 | Asno | 190/102 X |
| 4,759,431 | 7/1988 | King et al. | 190/108 X |
| 4,974,709 | 12/1990 | Thurlow et al. | 190/108 X |
| 5,018,609 | 5/1991 | Brenner | 190/108 |
| 5,050,713 | 9/1991 | Lee | 190/108 |

FOREIGN PATENT DOCUMENTS

| | | | |
|---|---|---|---|
| 290937 | 3/1916 | Fed. Rep. of Germany | 24/701 |
| 592673 | 8/1925 | France | 24/701 |
| 2506137 | 11/1982 | France | 190/108 |
| 20665 | of 1902 | United Kingdom | 24/701 |
| 327545 | 4/1930 | United Kingdom | 190/102 |
| 446009 | 4/1936 | United Kingdom | 190/102 |

*Primary Examiner*—Sue A. Weaver
*Attorney, Agent, or Firm*—Jones & Askew

[57] ABSTRACT

Luggage with improved apparatus for holding goods or auxiliary articles to a main piece of luggage. An auxiliary hook for carrying a separate piece, such as a briefcase, is removably attachable to a stud protruding outwardly from the luggage. The hook has a first opening to receive an enlargement at the outer end of the stud and a second opening to receive the relatively smaller post of the stud. The two openings are interconnected by a throat having resilient members permitting forceable movement of the stud from the larger opening to the smaller opening, whereat the stud retains the hook in place. In another embodiment, an auxiliary bag equipped with a strap extending to the hook, so that the auxiliary bag is selectively attachable to the outside of the luggage.

3 Claims, 3 Drawing Sheets

LUGGAGE WITH ATTACHABLE COMPONENTS

FIELD OF THE INVENTION

This invention relates in general to luggage, and relates in particular to portable luggage intended for accompanying the traveler.

BACKGROUND OF THE INVENTION

Luggage designed with sufficient portability to accompany the traveler wherever he or she goes is known in the art. Typical examples of portable luggage are garment bags and duffels intended to be stowed in the overhead bins of aircraft or, for smaller articles of luggage, to fit beneath the seat in front of the air traveler. The limited sizes of locations for stowing carry-on luggage mean that the luggage must fit within those spaces or, in the alternative, must be capable of folding to a minimum size appropriate for stowage. Such foldable luggage typical comes equipped with straps along its sides or ends, for securing the luggage in its folded configuration. These straps or similar securement members are unbuckled or unsnapped to permit unfolding or expanding the luggage to its full position, for example, allowing a garment bag to hang upright so that its contents become readily accessible.

Garment bags and other portable luggage have relied on various arrangements of buckles or snap fasteners to permit engagement and disengagement of straps or other members used for securing the luggage in a folded or more compact position for stowage or transport. The conventional buckle is relatively awkward to manipulate to an open or closed position, and the buckle components may protrude sufficient from some baggage to become damaged by baggage-handling machinery. The conventional snap fastener may permit a more compact arrangement of fastening strap and securement, but such snap fasteners are kept closed only by the friction force of the button-socket snap arrangement. If the snap fastener is designed with sufficient friction force to avoid becoming unsnapped during baggage handling or conveying, straps secured with such snap fasteners may be relatively difficult for the traveler to disconnect when desired.

Some portable luggage is equipped with wheels and a handle so that the traveler can easily bring the luggage without supporting its entire weight. One example of such luggage is shown in U.S. Pat. No. 4,995,478. In many situations, however, the traveler also carries separate bags such as a briefcase or equipment case, or a smaller auxiliary bag for stowing last-minute articles or objects that won't fit within the primary piece of luggage. These auxiliary articles or stowage bags often are propped onto the wheeled luggage or lashed in place by an arrangement of hooks and bungee cords, allowing the traveler to move in aggregation of portable luggage between the airplane, the air terminal, and ground transportation. However, once the traveler arrives at the aircraft, it may become necessary to detach these auxiliary articles as well as any separate hooks or attachments used to temporarily secure the articles to the primary piece of luggage. Once again, conventional securement or attachment devices such as button snaps can prove awkward or time-consuming for the traveler to disconnect, particularly in the crowded environment of an aircraft cabin during boarding.

SUMMARY OF INVENTION

Accordingly, it is an object of the present invention to provide improved luggage.

It is another object of the present invention to provide portable luggage having auxiliary components easily attachable thereto.

It is another object of the present invention to provide luggage with improved apparatus for connecting and disconnecting an auxiliary article to the luggage.

Stated in general terms, luggage according to the present invention substitutes a stud and clasp attachment structure for the conventional snaps, buckles, or other fasteners previously employed for the purpose. This attachment structure enabled a piece of luggage, so equipped, to support and carry an auxiliary article, such as another bag equipped with a complementary hook or a conventional piece such as a briefcase or the like.

Stated in greater detail, the stud is mounted on an exterior surface of the luggage and has a portion extending outwardly from that surface. The clasp is engageable with and releasable from the stud with a sliding movement requiring a minimum amount of force, but the clasp cannot be inadvertently removed from the stud when so engaged. The clasp may be attached to a strap connected to the luggage and used for maintaining the luggage in a folded or compact position. Alternatively, the clasp may be attached to a separate carrier for supporting an article such as a briefcase or the like separate from the luggage itself.

Stated somewhat more particularly, the stud includes a post mounted on and extending outwardly from an exterior surface of the luggage. This post has an enlarged portion spaced apart from the surface. The clasp, in turn, includes a socket releasably engageable with the stud. This socket includes a portion that engages the enlarged portion of the stud, so that the clasp remains selectively retained on the stud. In a preferred embodiment, the hook has a first aperture of sufficient size to permit entry and withdrawal of the enlarged portion of the stud. A second aperture of the clasp is sized to receive the post but not to permit passage of the enlarged portion. The first and second apertures are adjacent to each other and are connected by a throat of sufficient size to permit moving the post from first to second apertures, and vice versa. The throat is configured so that movement of the post from the second aperture to the first aperture resiliently deforms a member, and that deformation preferably requires a relatively greater amount of manual force than the first-mentioned movement, so that a greater effort is required to disengage the clasp from the stud than to attach the hook thereto in the first place.

Other objects and advantages of the present invention will become more readily apparent from the following discussion of preferred embodiments.

DETAILED DESCRIPTION OF PREFERRED EMBODIMENTS

Figure 1:
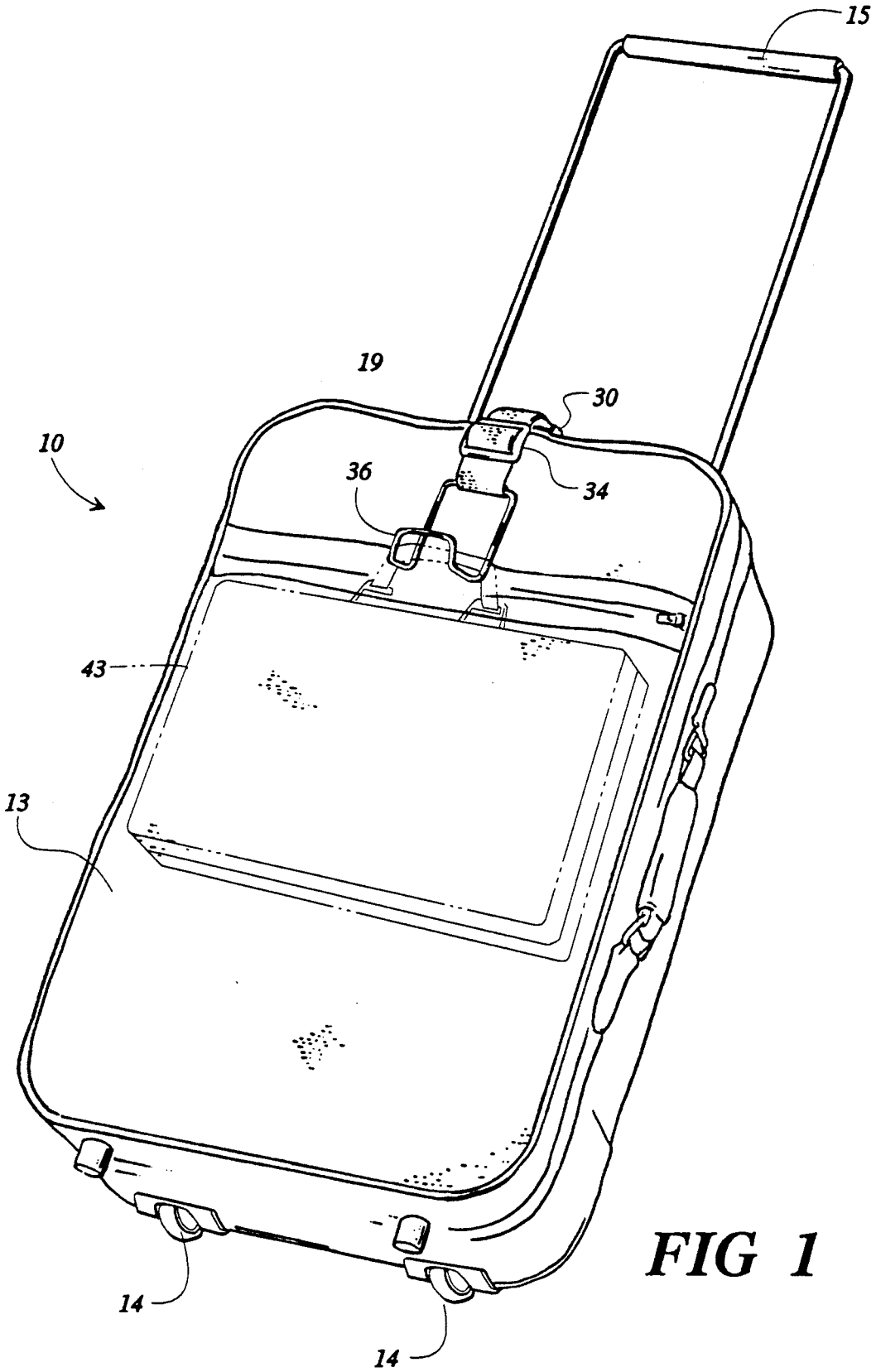
FIG. 1 is a pictorial view showing a piece of luggage equipped according to the present invention.
Figure 2:
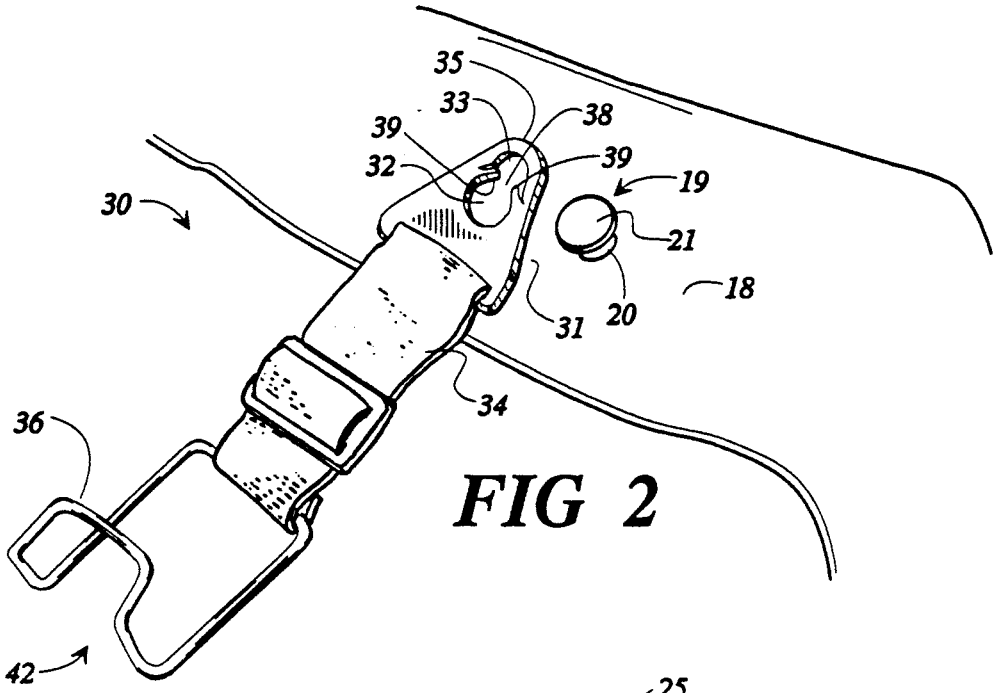
FIG. 2 is a fragmentary pictorial view showing in detail the attachment mechanism used in the embodiment of FIG. 1.
Figure 3:
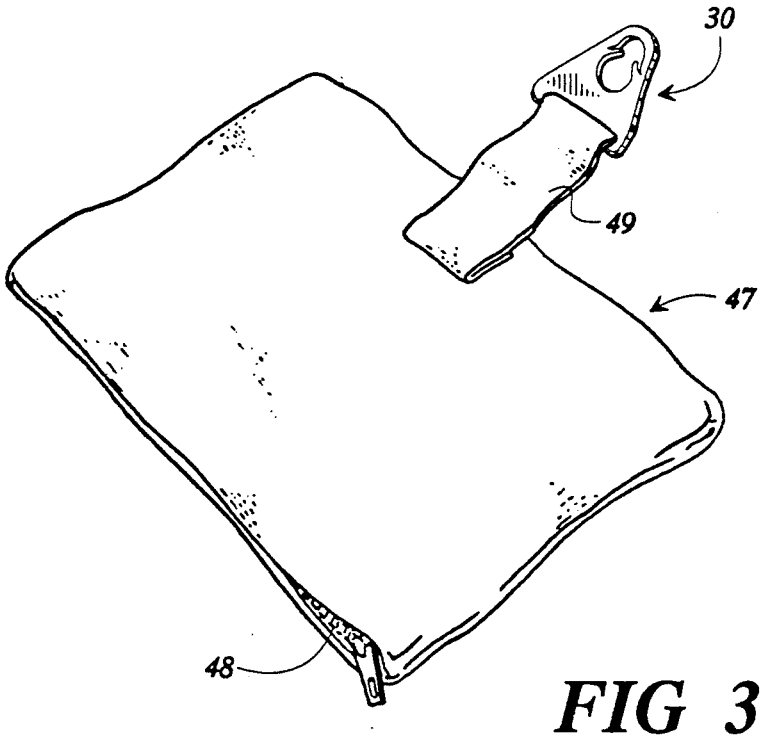
FIG. 3 is a pictorial view showing an alternative application of the present attachment mechanism.

Turning first to FIGS. 1–3, there is shown generally at 10 an article of luggage having a soft-sided body 13, wheels 14 at a lower end of the body for towing the luggage across a floor, and a handle 15 conveniently positioned for towing the luggage by a traveler. The handle 15 preferably is telescopically received within the luggage, to permit collapsing the handle into the luggage when the handle is not in use. Further details of the luggage 10 as described thus far are found in U.S. Pat. No. 4,995,487.

Figure 2A:
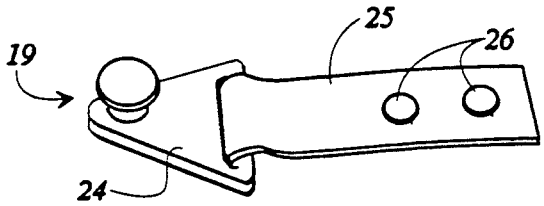
FIG. 2A shows an alternative construction for attaching the stud in FIG. 2.

Turning to FIG. 2, it can be seen that the luggage 10 according to the present invention has a top end 18 to which is fastened a stud 19 used for selectively attaching another piece to the luggage. This other piece may be an auxiliary carrying bag designed for use with the luggage, or may be a conventional article such as a briefcase, attaché case, or equipment carrier, as explained below in greater detail. The stud 19 has a post 20 extending outwardly from the outside surface of the top end 18, with a button-shaped enlargement 21 formed at the outer end of the post. Both the post 20 and the enlargement 21 are circular in shape and are mutually concentric, in the preferred embodiment. The post 20 of the stud 19 may be connected directly to the top end 18 of the luggage, for example, by a component extending through the fabric or other material making up the top end. Alternatively, as shown in FIG. 2A, the post may be molded or otherwise attached to a tab 24, held in place on the luggage by a short connecting strap 25 affixed to the top end 18 by suitable fasteners such as the rivets 26 or the like.

The stud 19 selectively engages a clasp 30 configured for selective and removable attachment to the stud. The clasp 30 includes a flat support member 31, of triangular shape in the preferred embodiment, connected at one broad end to an auxiliary strap 34 extending through a slot at the broad end of the member. The strap 34 is shown in FIG. 2 connecting the clasp 30 to a generally J-shaped auxiliary hook member 36. A relatively large aperture 32 extends through the member 31 at a location spaced between the strap 34 and the remotely-located narrow end 35 of the member. The aperture 32 is large enough to permit free passage of the button-shaped enlargement 21 on the stud, and that aperture preferably is circular so as to accommodate the cylindrical shape of the enlargement.

The clasp 30 further includes a relatively small aperture 33 extending through the member 31 at a location between the relatively large aperture 32 and the narrow end 35 of the member. This smaller aperture 33 may be diametrical in shape, and the smaller aperture overlaps a part of the larger aperture 32 so as to define a throat 38 interconnecting the two apertures. The diameter of the smaller aperture 33 is chosen to accommodate the diameter of the post 20 for the stud 19, so that the post is snugly yet preferably movably positionable within the smaller aperture. However, the diameter or other overall configuration of the smaller aperture 33 is less than the corresponding size and shape of the enlargement 21 at the outer end of the post 20, so that the enlargement cannot pass through the smaller aperture.

The throat 38 interconnecting the large aperture 32 and the small aperture 33 is defined by the pair of fingers 39 extending outwardly from each side of the throat. These fingers 39 are formed in the member 31 by molding or the like, and the fingers define the width of the throat 38 to be somewhat less than the diameter of the post 20. The fingers 39 are resilient or otherwise deformable by an amount which allows enlarging the throat 38 sufficiently so as to permit forcing the post 20 to move from the larger aperture 32 to the small aperture 33 and vice versa. Moreover, the fingers 39 preferably, although not necessarily, are designed so that a relatively lesser amount of force is required when deforming the fingers by moving the post 20 from the large aperture 32 to the small aperture 33, but a somewhat greater amount of force is required to deform the fingers when moving the post in the opposite direction. As shown in FIG. 2, one way of accomplishing this unequal force is by angling the fingers 39 toward the small aperture 33, thus providing camming surfaces engageable by the post 20 when moving the stud 19 from the large aperture 32 to the small aperture.

The apparatus as described thus far may be used in the manner shown in FIG. 1. For example, a person towing the luggage 10 from place to place can also carry a conventional separate piece, such as the attache case 43, with the luggage, thereby leaving the person with one hand unencumbered by that separate piece. This is accomplished by attaching the clasp 30 to the complementary stud 19 at the top end 18 of the luggage, leaving the hook member 36 extending downwardly from the top along the upper end of the luggage as shown in FIG. 1. The attache case 43 next is laid along the side of the luggage, with the existing handle 44 slipped over the hook member 36 supported by the strap 34. The hook 30 at this time has been attached to the stud 19 by first placing the stud enlargement 21 through the large opening 32 in the support member 31, and then laterally displacing the clasp 30 relative to the stud 19 with enough force to resiliently displace the fingers 39, thereby allowing the post 20 of the stud to move from the large opening 32 to the small opening 33. The resilient fingers 39 captivate the post 20 within the small aperture 33, and the enlargement 21 prevents the support member 31 from being lifted off the stud. The clasp 30 thus remains in place on the luggage 10 supporting a separate piece such as the case 43, as the traveler wheels the luggage 10 from place to place or momentarily parks that luggage in the upright position.

When the traveler desires to detach the clasp 30 from the luggage, the member 31 is moved relative to the stud 19 with sufficient force to again deform the fingers 39, allowing the post 20 to pass from the small aperture 33 to the large aperture 32. That movement realigns the enlargement 21 with the large aperture, and the member 31 is easily withdrawn from the stud.

FIG. 3 shows an alternative application of the clasp apparatus 30. In place of the hook member 36 attached to the free end of a strap 34 as in FIG. 2, an auxiliary bag 47 is secured to the clasp assembly by the strap 49, which preferably is permanently attached to the auxiliary bag. This auxiliary bag 47 can have a zipper closure or the like 48 at one end, and the auxiliary bag is particularly useful for storing articles that would not fit within the luggage 10 or for adding last-minute acquisitions without having to open and repack the luggage.

Figure 4:
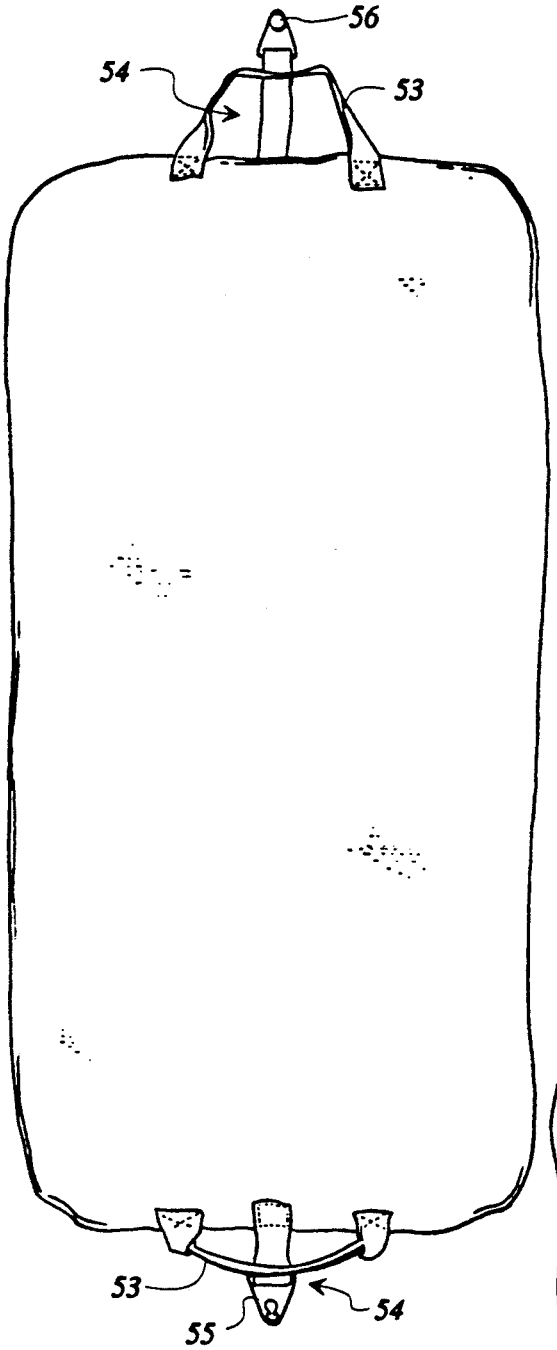
FIG. 4 is a pictorial view showing an alternative embodiment of luggage according to the present invention.
Figure 5:
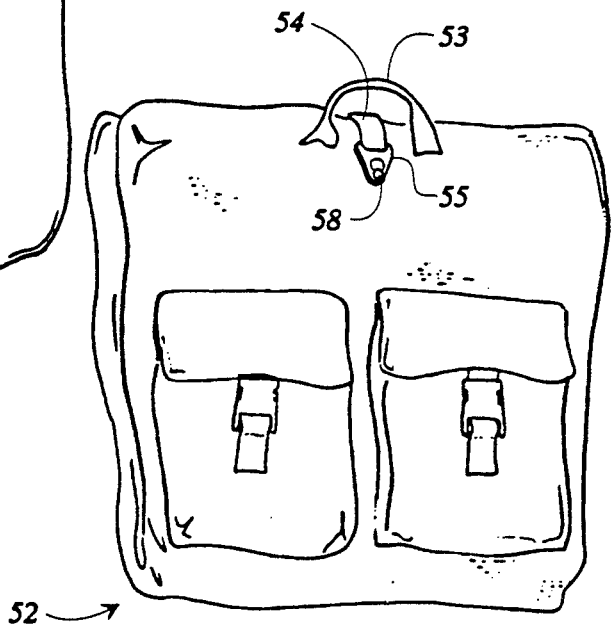
FIG. 5 shows the luggage of FIG. 4 in folded configuration.

Turning now to the embodiments shown in FIGS. 4 and 5, there is shown at 52 a garment bag including a conventional carrying handle 53 at each end of the bag. This garment bag 52 also is shown with separate connecting straps 54 extending outwardly from each end of the garment bag. One of these straps has at its outer end a clasp 55 equivalent to the clasp 30 shown in FIG. 2. The other strap 54 has at its outer end a stud 56 complementary to the clasp 55. The garment bag 52 may also have a separate stud 58 (FIG. 5) attached to the bag adjacent either or both ends of the bag.

When the garment bag 52 is folded as shown in FIG. 5, the carrying handles 53 overlaps one another in the conventional manner. The two connecting straps now substantially overlap one another, allowing the clasp 55 to engage the stud 56 and thereby retain the bag in its folded position.

Alternatively, the clasp 55 attached to the strap 54 can be connected to the stud 58 when the garment bag 52 is folded. This separate stud 58 also is useful to receive the hook 30 at the end of the strap 34 or 49 when the garment bag 52 is folded, thereby supporting an auxiliary bag or the like on the folded garment bag.

It should be understood that the foregoing relates only to preferred embodiments of the present invention, and that numerous modifications and changes therein may be made without departing from the spirit or scope of the invention as defined in the following claims.

What is claimed is:

1. A case for holding goods, comprising:

a stud mounted to an exterior surface of said case, said stud having an enlargement and a post extending outwardly from said exterior surface to said enlargement;

a clasp comprising a support member with a first aperture that is larger than said enlargement and a second aperture that is smaller than said enlargement, said first and second apertures being connected by a throat with at least one resilient finger disposed therein, to point toward said second aperture, said clasp being selectively operable for releasable engagement with said stud by passing said enlargement through said first aperture and urging said post into said second aperture; and support means connected with said clasp for supporting an article separate from said case.

2. A case for holding goods, comprising:

a stud mounted on an exterior surface of said case, said stud having an enlargement and a post extending outwardly from said exterior surface to said enlargement;

a clasp comprising a support member with a first aperture that is larger than said enlargement and a second aperture that is smaller than said enlargement, said first and second apertures being connected by a throat with a pair of resilient fingers disposed therein, to point toward said second aperture, said clasp being selectively operable for releasable engagement with said stud by passing said enlargement through said first aperture and urging said post into said second aperture; and support means connected with said clasp for supporting an article separate from said case.

3. A case for holding goods as recited in claim 2, wherein the shortest distance between ends of each of said pair of resilient fingers is less than the thickness of said post.

* * * * *